US012495935B1

(12) United States Patent
Podemska-Mikluch et al.

(10) Patent No.: US 12,495,935 B1
(45) Date of Patent: Dec. 16, 2025

(54) PORTABLE CHILD SINK

(71) Applicants: Marta Podemska-Mikluch, Belle Plaine, MN (US); Lukasz Andrzej Mikluch, Belle Plaine, MN (US)

(72) Inventors: Marta Podemska-Mikluch, Belle Plaine, MN (US); Lukasz Andrzej Mikluch, Belle Plaine, MN (US)

( * ) Notice: Subject to any disclaimer, the term of this patent is extended or adjusted under 35 U.S.C. 154(b) by 246 days.

(21) Appl. No.: 18/487,174

(22) Filed: Oct. 16, 2023

Related U.S. Application Data

(63) Continuation-in-part of application No. 17/516,945, filed on Nov. 2, 2021, now Pat. No. 11,793,361, which is a continuation of application No. 16/819,962, filed on Mar. 16, 2020, now Pat. No. 11,197,585.

(60) Provisional application No. 62/823,766, filed on Mar. 26, 2019.

(51) Int. Cl.
*A47K 1/02* (2006.01)
*A47K 1/04* (2006.01)
*A47K 1/12* (2006.01)

(52) U.S. Cl.
CPC ..... *A47K 1/02* (2013.01); *A47K 1/04* (2013.01); *A47K 1/12* (2013.01)

(58) Field of Classification Search
CPC ... A47K 1/02; A47K 1/04; A47K 1/12; A47K 1/05; E03C 1/05; E03C 1/057
See application file for complete search history.

(56) References Cited

U.S. PATENT DOCUMENTS 1,751,294 A * 3/1930 Spital ..... A47K 1/02 4/626
4,769,863 A * 9/1988 Tegg ..... A47K 1/12 4/619
5,182,822 A * 2/1993 Cyr ..... A47K 1/02 446/167
5,301,376 A * 4/1994 Herbert ..... A47K 1/02 220/379
5,502,848 A * 4/1996 Cowan ..... A47K 1/02 4/654
5,704,078 A * 1/1998 Chandler ..... A47K 11/02 4/449
D409,732 S * 5/1999 Maddux ..... D23/286
5,915,417 A * 6/1999 Diaz ..... E03C 1/057 137/624.11

(Continued)

*Primary Examiner* — Jeremy Carroll
(74) *Attorney, Agent, or Firm* — Mai D. Lauer; Westman, Champlin & Koehler, P.A.

(57) ABSTRACT

An apparatus includes a base, a reservoir, a vessel, a conduit, a sensor, a resistance measurement wire connected to the conduit, a microprocessor, and a pump. The reservoir is configured to hold a fluid such as water or soap. The microprocessor is configured to receive a signal from the sensor indicative of whether an object (such as a user's hand) is disposed proximate the sensor and receive a second signal from the resistance measurement wire indicative of a resistance measurement of the conduit. The pump is configured to provide a motive force to the fluid through the conduit in a circumstance in which the signal indicates that the object is disposed proximate the sensor and the second signal indicates that the resistance measurement of the conduit is above a threshold, wherein the threshold corresponds to a lack of the fluid in the conduit.

18 Claims, 11 Drawing Sheets

(56) References Cited

U.S. PATENT DOCUMENTS

| | | | | | |
|---|---|---|---|---|---|
| 6,161,228 | A * | 12/2000 | Wietecha | A47K 1/02 | 4/625 |
| 6,173,458 | B1 * | 1/2001 | Maddux | A47K 1/02 | 4/619 |
| 6,253,394 | B1 * | 7/2001 | Goyette | A47K 1/02 | 4/626 |
| 7,490,375 | B2 * | 2/2009 | Luk | E03C 1/264 | 210/238 |
| 7,802,327 | B1 * | 9/2010 | Moceri | A47K 1/02 | 4/619 |
| 8,082,611 | B1 * | 12/2011 | Marshall | A47K 1/02 | 239/146 |
| 8,925,124 | B2 * | 1/2015 | Littlehorn, Sr. | A47K 1/02 | 4/654 |
| 2004/0148697 | A1 * | 8/2004 | Patterson | A47K 1/02 | 4/619 |
| 2007/0056091 | A1 * | 3/2007 | Bolton | A47K 1/02 | 4/619 |
| 2007/0199146 | A1 * | 8/2007 | Kostelyk | E03B 11/02 | 4/625 |
| 2010/0051639 | A1 * | 3/2010 | Stob | B60R 15/02 | 222/608 |
| 2011/0296605 | A1 * | 12/2011 | Kerr | A47K 1/12 | 4/650 |
| 2012/0233769 | A1 * | 9/2012 | Song | A61C 17/14 | 4/625 |
| 2013/0019908 | A1 * | 1/2013 | St-Pierre | B08B 3/006 | 134/105 |
| 2015/0083748 | A1 * | 3/2015 | McHale | E03C 1/057 | 222/52 |
| 2021/0161333 | A1 * | 6/2021 | Clawson | A47K 1/04 | |

* cited by examiner

PORTABLE CHILD SINK

CROSS REFERENCE TO RELATED APPLICATIONS

This application is a continuation-in-part of U.S. patent application Ser. No. 17/516,945, filed Nov. 2, 2021; which is a continuation of U.S. patent application Ser. No. 16/819,962, filed Mar. 16, 2020, now U.S. Pat. No. 11,197,585; which claims the benefit of priority from U.S. Provisional Patent Application No. 62/823,766, filed Mar. 26, 2019; the contents of these priority applications are hereby incorporated by reference in their entireties.

BACKGROUND

A portable child sink is described to offer toddlers a sink experience similar to what adults know and enjoy. It is sized and configured to allow toddlers to wash their hands and brush their teeth, thereby instilling healthy habits. Such an apparatus is a perfect educational gift for a baby's first birthday.

There already exist small tubs and mini toilets. While other child sinks are known, they often include drawbacks, such as a requirement for plumbing hook-ups to a building's water supply pipes. Such designs are therefore unsuitable for locations where such plumbing access is inconvenient or unavailable. Moreover, such design requirements increase cost and decrease flexibility in placement and mobility. Accordingly, there is a need for a child sink that is simple to set up and use, as well as easy to move to different locations.

SUMMARY

In one aspect, an apparatus comprises a base, a first reservoir, a first vessel, a first conduit, a first sensor, a first resistance measurement wire connected to the first conduit, a microprocessor, and a first pump. In an exemplary embodiment, the first reservoir, is disposed on the base and is configured to hold a first fluid such as water or soap. In an exemplary embodiment, the first vessel has a first volume equal to or greater than a volume of the reservoir, and the first vessel is configured to be connected to the base. In an exemplary embodiment, the first conduit is configured to deliver the first fluid (such as water or soap) from the first reservoir to at least the first vessel. In an exemplary embodiment, the microprocessor is configured to receive a first signal from the first sensor indicative of whether an object (such as a user's hand) is disposed proximate the first sensor and receive a second signal from the first resistance measurement wire indicative of a resistance measurement of the first conduit. The first pump is configured to provide a motive force to the first fluid through the first conduit in a circumstance in which the first signal indicates that the object is disposed proximate the first sensor and the second signal indicates that the resistance measurement of the first conduit is above a first threshold, wherein the first threshold corresponds to a lack of the first fluid in the first conduit.

In another aspect, an exemplary method comprises receiving a first signal from the first sensor indicative of whether an object (such as a hand) is disposed proximate the first sensor; receiving a second signal from the first resistance measurement wire indicative of a resistance measurement of the first conduit, wherein a first threshold corresponds to a lack of the first fluid in the first conduit; determining that the first signal correlates with presence of the object proximate the first sensor; determining that the second signal correlates with the lack of the first fluid (such as water or soap) in the first conduit; and providing a first motive force to the first fluid through the first conduit, with the first pump.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1:
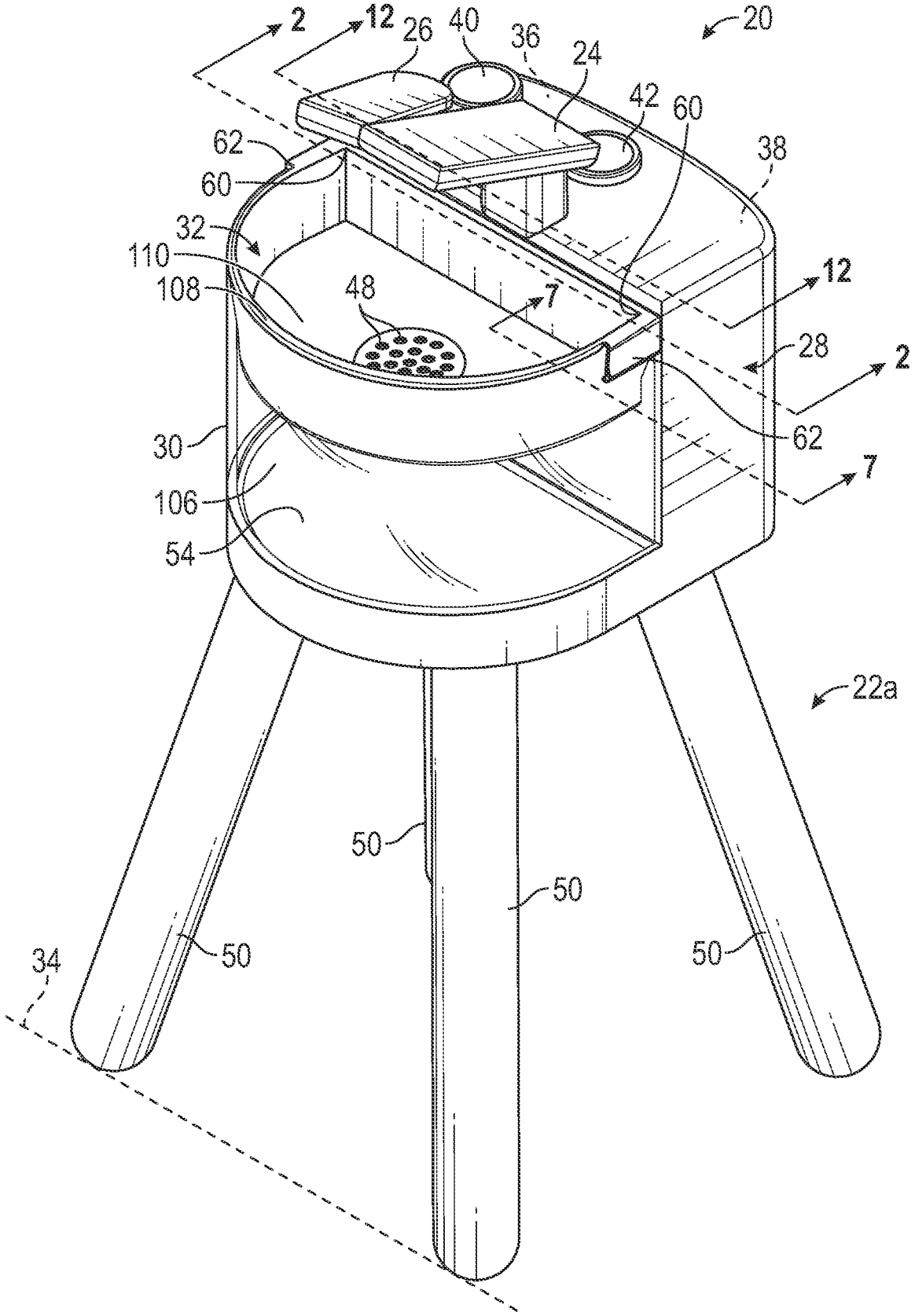
FIG. 1 is a perspective view of an exemplary sink with an optional leg assembly.
Figure 2:
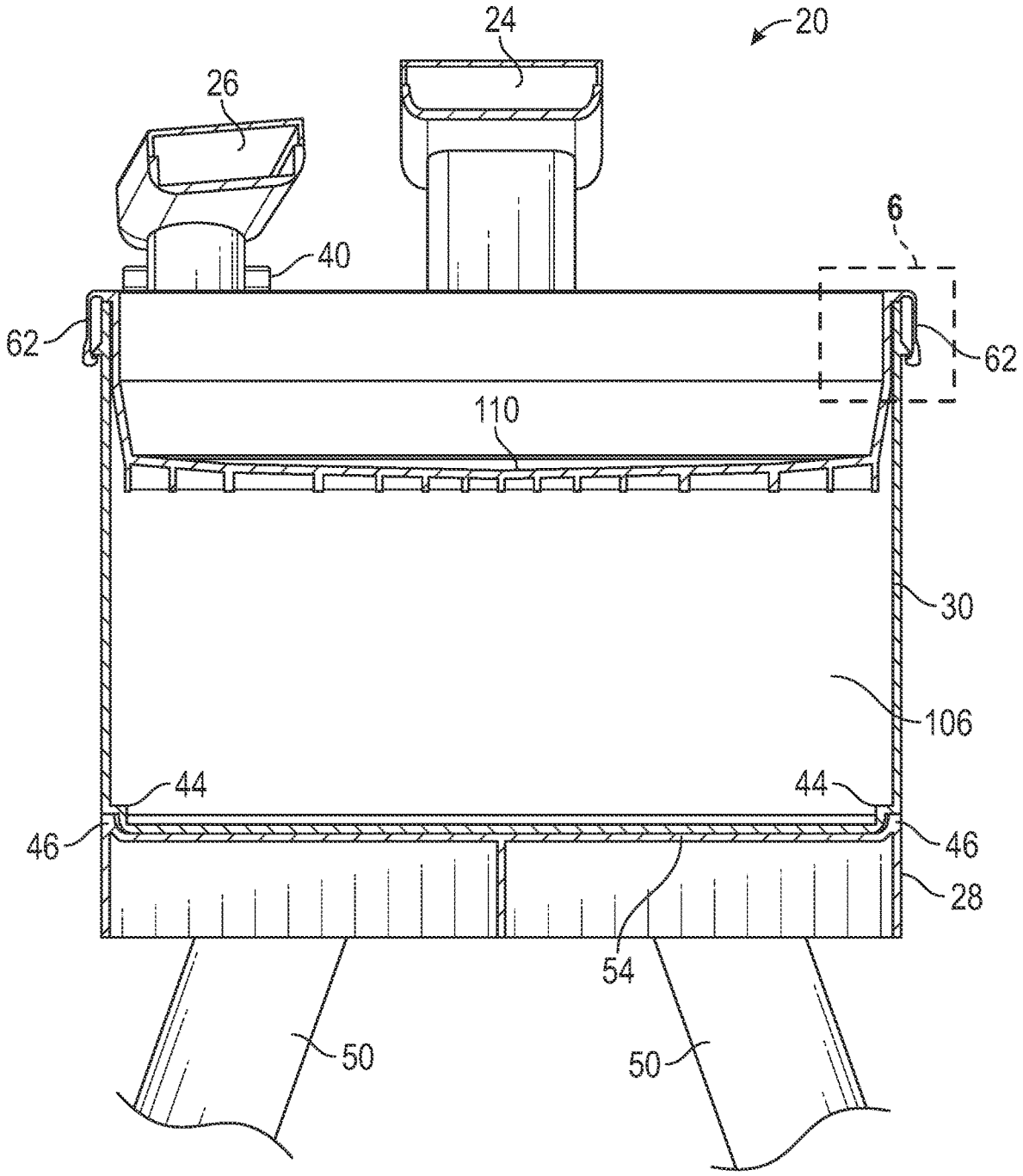
FIG. 2 is a cross-sectional view of the exemplary sink, taken along line 2-2 of FIG. 1.
Figure 3:
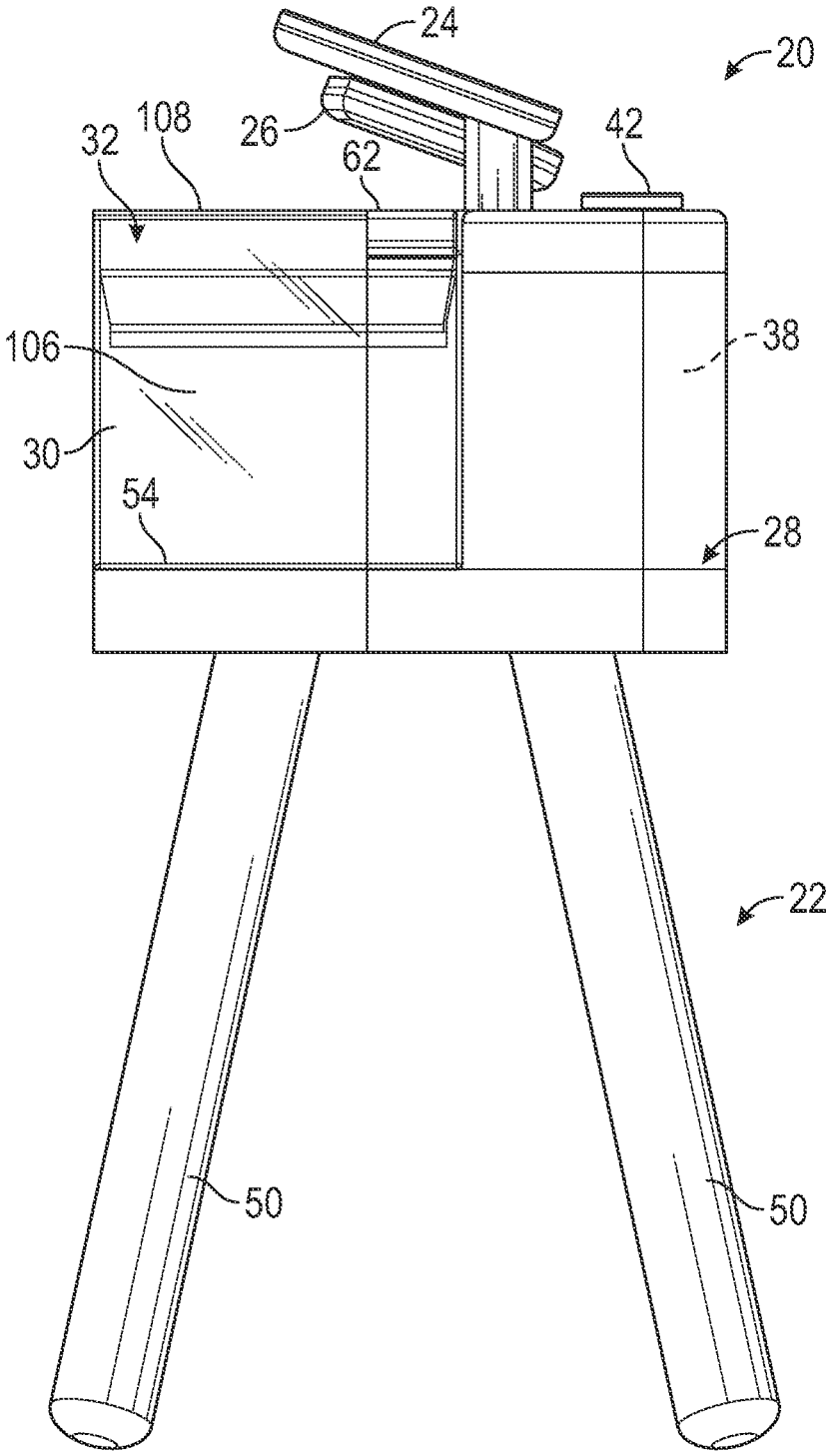
FIG. 3 is a side elevation view of the exemplary sink.

FIG. 1 is a perspective view of an exemplary portable child sink 20 with an optional leg assembly. FIG. 2 is a partial cross-sectional view, taken along line 2-2 of FIG. 1. FIG. 3 is a side elevation view of the exemplary sink. Sink 20 is light and portable. Because there is no required plumbing or electrical hook-up, sink 20 can be placed at any location around the house or even outside. Bathrooms are an obvious location, but it can also be placed in a child's bedroom, kitchen, mudroom, or other location, such as daycare centers and in-home daycares.

Sink 20 is a perfect addition to potty-training, but it can also be used much earlier in a child's development, as soon as she or he learns to stand unsupported. Starting so early ensures that children form a habit of washing hands after coming home, before meals, and at other appropriate times. In an exemplary embodiment, faucet 24 and soap dispenser 26 are motion-activated to facilitate ease of use for toddlers, versus traditional handles and levers that could be hard to reach and operate, and wasteful if left on by an inattentive child. Such motion-activated features can be battery-operated, thereby eliminating a need for an electrical outlet.

Figure 11:
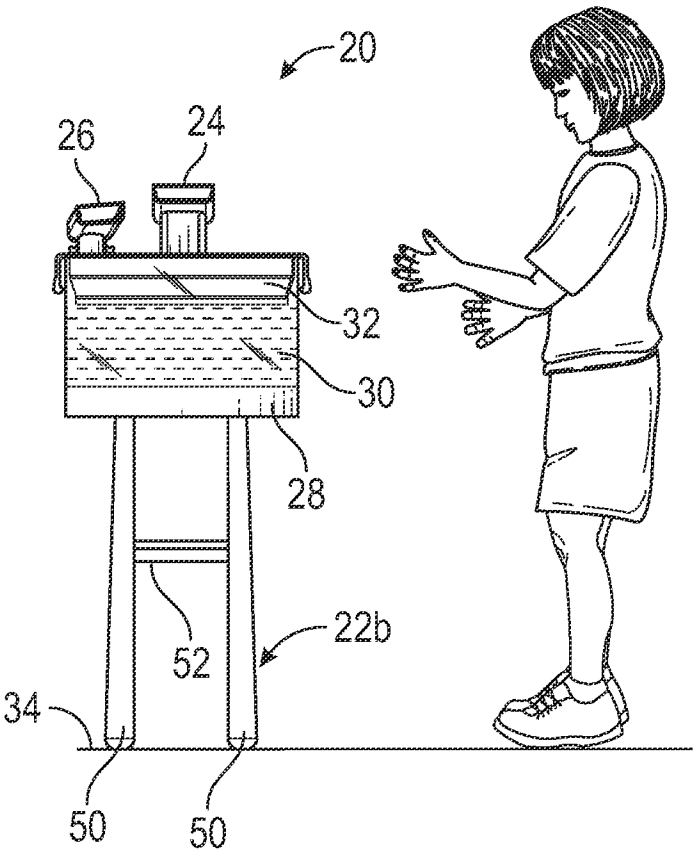
FIG. 11 is a front elevation view of an exemplary sink placed on an optional leg assembly to raise the sink above a floor surface, for use by a taller child.

In an exemplary embodiment, sink 20 includes faucet 24 and soap dispenser 26 on base 28, waste water container 30, upper tray 32. Accessories include a leg assembly 22 having legs 50. In an exemplary embodiment, different sets of leg assemblies 22 are provided to enable support of sink 20 at various heights above floor surface 34. For example, FIG. 1 shows relatively shorter leg assembly 22*a*, while FIG. 11 shows relatively longer leg assembly 22*b*.

Figure 4:
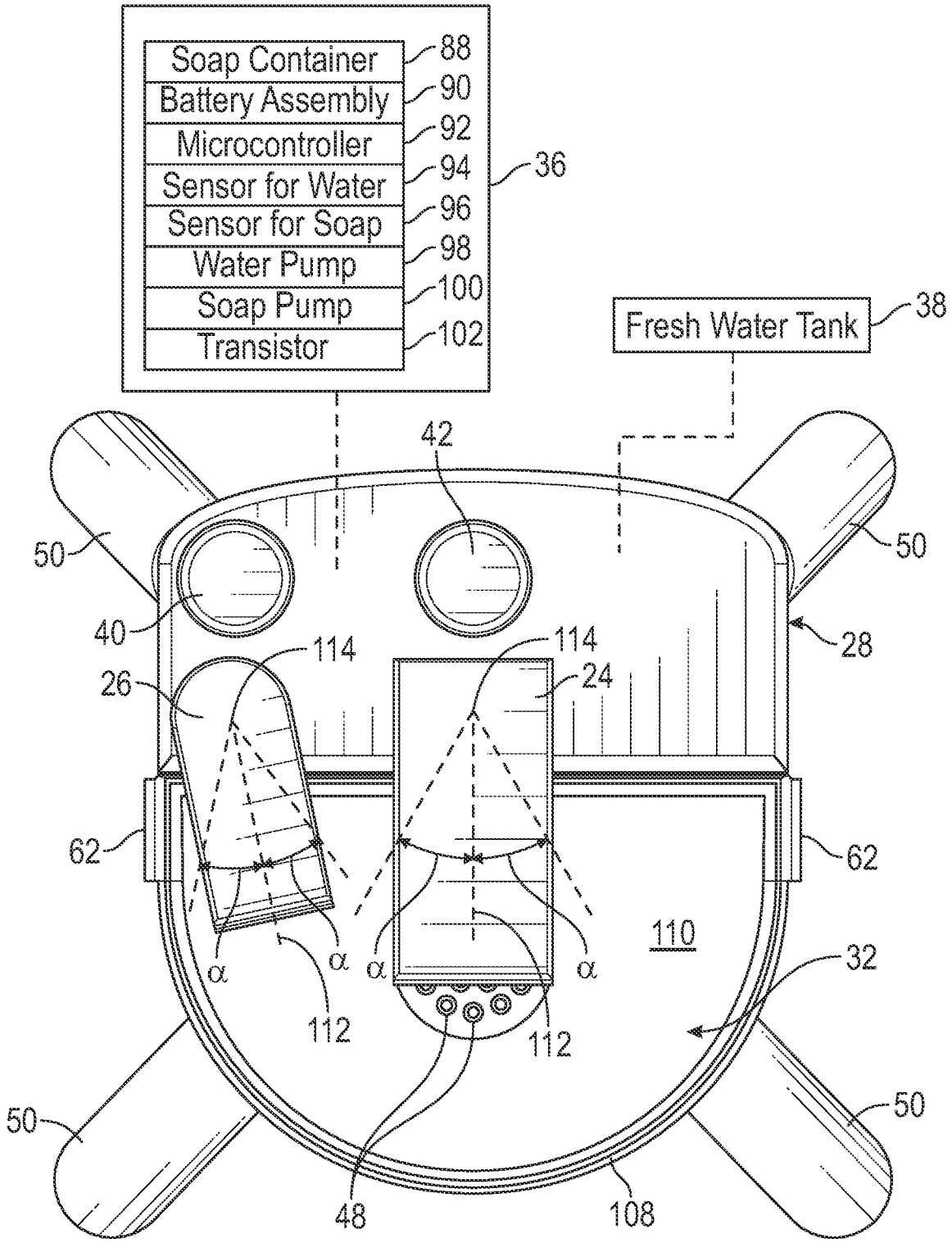
FIG. 4 is a top view of the exemplary sink.

FIG. 4 is a top view of the exemplary sink 20, also showing components that are internal to the housing 36 of base 28 in boxes. One portion of the base 28 includes a housing 36, which contains soap container 88, battery assembly 90, microcontroller 92, sensor 94 for water dispensing, sensor 96 for soap dispensing, water pump 98, soap pump 100, and transistors 102, among other electronic items and internal components. Base 28 also includes an internal fresh water tank 38.

To prepare sink 20 for use, several steps may be performed. For battery insertion and replacement in the housing 36, ensure that an On/Off switch (not labeled) is set to "Off" so that the motion/object sensors are powered off. Remove the battery compartment cover (not labeled) of battery assembly 90, insert or replace the batteries in the compartment, and replace the battery compartment cover.

In an exemplary embodiment, each of the faucet 24 and soap dispenser 26 can pivot about vertical pivot axis 114 within a limited range of angle $\alpha$ relative to its default longitudinal orientation 112 of the illustrated position. In an exemplary embodiment, the angle $\alpha$ is about 30 radial degrees. Thus, a full range of motion of each of the faucet 24 and soap dispenser 26 is about 60 radial degrees. However, it is contemplated that a user may not want to rotate the soap dispenser to its extreme outside capabilities, in order to keep any dispensed liquid above the containers 30, 32.

Figure 14:
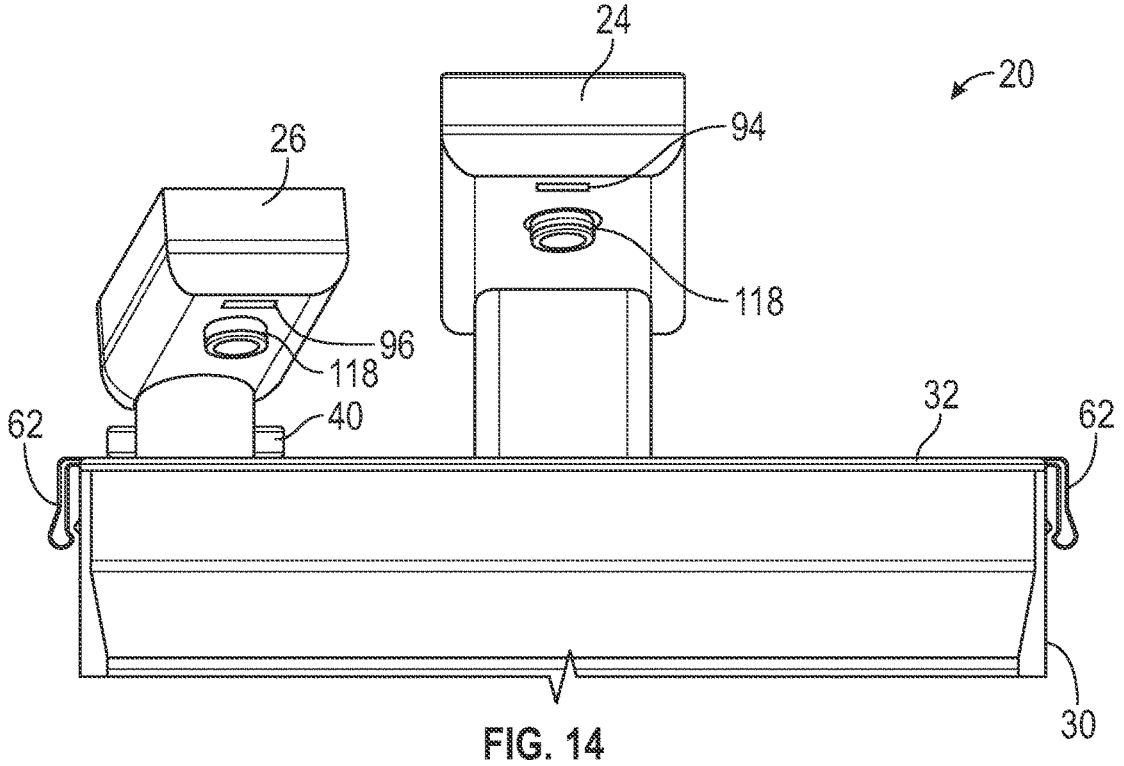
FIG. 14 is a partial front elevation view of an upper portion of the sink.
Figure 15:
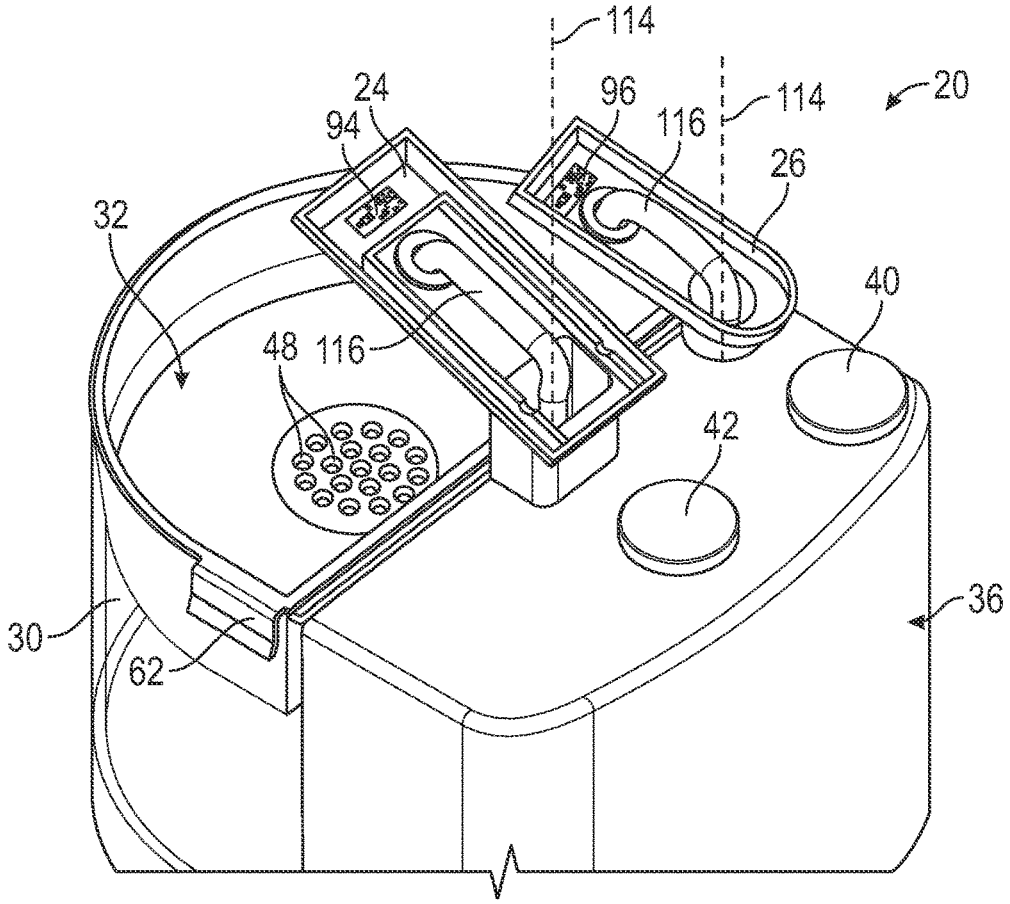
FIG. 15 is a partial top and rear perspective view of the sink, with upper portions of the faucet and soap dispenser removed.

As shown in FIG. 15, the exemplary tubes or pipes 116 are flexible to accommodate this range of motion. Such pivoting capability allows for versatility in the positioning of the liquid dispensing nozzles 118 of each of the water faucet 24 and soap dispenser 26. In an exemplary embodiment, each of the faucet 24 and soap dispenser 26 pivots independently, so that the respective nozzles 118 can be brought closer together or farther apart. For example, referring to FIGS. 14 and 15, if the user finds that because of the size of the user's hands, or the typical hand motions of the user, that the motion sensor 96 for soap causes excess soap dispensing when only water dispensing is desired (because having hands under the water sensor 94 also peripherally triggers the soap sensor 96), the sensors 94, 96 can be moved farther from each other by pivoting the dispensers 24, 26 relative to housing 36 of base 28.

Figure 5:
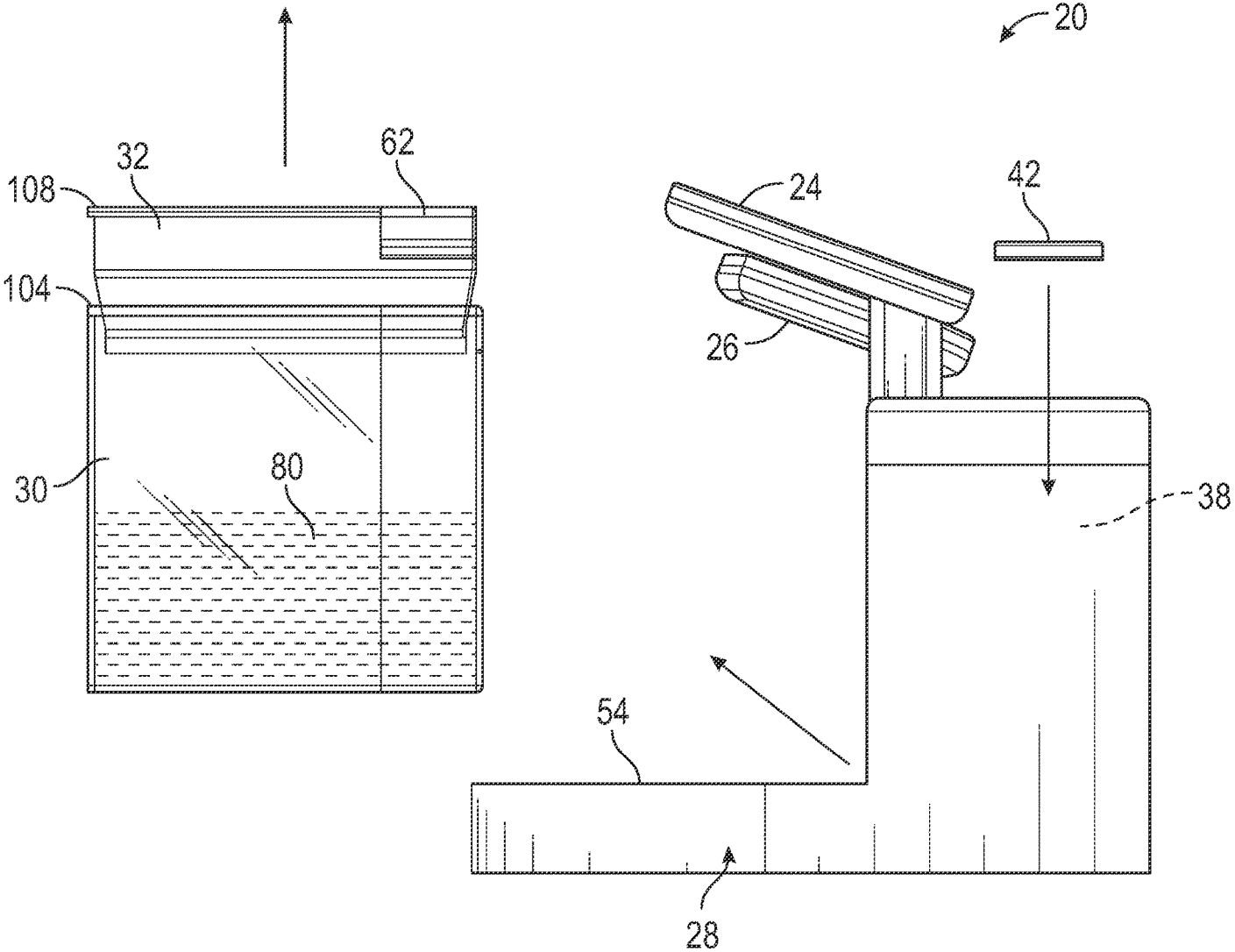
FIG. 5 is a side elevation exploded view of the exemplary sink.

As shown in FIGS. 4 and 5, fresh water tank 38 includes a removable water tank plug 42. A user removes plug 42, such as by lifting it from a fill hole, to allow for the filling of fresh water tank 38. In an exemplary method of use, waste water container 30 is removed from base 28, emptied, cleaned, and filled with fresh water 80 by an adult at a plumbed faucet of a building or outdoor hose. The water 80 is poured from waste water container 30 and into the opening of fresh water tank 38 (with water tank plug 42 removed therefrom). In an exemplary embodiment, a volumetric capacity of fresh water tank 38 is about one liter, and a capacity of waste water container 30 is greater than the capacity fresh water tank 38. Accordingly, waste water container 30 would not overflow from use of sink 20, as an adult would empty waste water container 30 before refilling fresh water tank 38. In an exemplary embodiment, the waste water container 30 can include a marking to indicate a "fill line" for a volume that fills fresh water tank 38. In an exemplary embodiment, a soap container 88 accessible through an opened soap plug 40 is also fillable and refillable.

An exemplary method of use includes inserting upper tray 32 into waste water container 30 so that an upper rim flange 108 of upper tray 32 rests upon an upper sidewall edge 104 of waste water container 30. In an exemplary embodiment, the upper tray 32 and waste water container 30 are secured together by cooperating clips 62 at the connecting upper rims of upper tray 32 and waste water container 30. Upper tray 32 has a smaller volumetric capacity than waste water container 30. Upper tray 32 has a plurality of drain holes 48, allowing water 80 to drain from upper tray 32 to waste water container 30. The components of sink 20 are sized so that much or all of the water from fresh water tank 38, after use via faucet 24, will drain through holes 48 and be retained in waste water container 30. This offers advantages over washing hands in a simple bowl, because the water 80 is drained away from the child's reach, thereby prevent spilling and splashing. The affirmative attachment between tray 32 and waste water container 30 ensures that the parts 30, 32 remain connected until an adult intends to disconnect them. While a clipping attachment is described between tray 32 and waste water container 30, it is contemplated that other attachments can be used, such as snap fit structures, for example.

For use, an adult flips the On/Off switch on housing portion 36 to "On" to enable motion/object sensors as shown in FIGS. 14 and 15. Sensor 94 is provided for dispensing water, and sensor 96 is provided for dispensing soap. A child can dispense water or soap as appropriate by waving his or her hands near the faucet 24 (and water sensor 94) or soap dispenser 26 (and soap sensor 96). In an exemplary embodiment, components of sink 20 are sized to provide for several hand washings before adult attention is needed to empty the waste water container 30 and refill the fresh water tank 38.

The parts of sink 20 are easy to clean after mutually separating the upper tray 32, waste water container 30 and base 28, as shown in FIGS. 5-9. Empty any water in the waste water container 30 and the fresh water tank 38. Wash each of the upper tray 32 and waste water container 30 with a mixture of water and mild soap; dry with a dry cloth. Optionally, upper tray 32 and waste water container 30 may be cleaned in an automatic dishwasher. Because the housing 36 contains electrical components, it should not be immersed. Rather, base 28 can be cleaned by wiping surfaces with a damp, soft cloth or pre-moistened wipe. All parts should be allowed to dry.

In an exemplary embodiment, sink 20 is primarily composed of various types of plastics, along with other metallic and non-metallic content found with any commercial electric/electronic components used in this product. Polypropylene-type plastics are especially suitable, chosen for their strength, fatigue resistance, lack of toxicity, and reasonable temperature tolerance. Plugs 40 and 42 are suitably composed of a flexible nitrile rubber compound.

In an exemplary embodiment, waste water container 30 functions to collect and contain the used waste-water 80 after hand washing. In an exemplary embodiment, waste water container 30 is shaped like an open-ended half-cylinder, oriented with the open end accessible from above, and with the flat, rectangular edge of the half-cylinder facing the vertical wall of base 28. This shape presents a curved surface to the user, with no sharp corners facing the child. Although a semi-circular shape is exemplary, it is understood that waste water container 30 and a correspondingly shaped upper tray 32 can have other shapes, including a rounded cuboid, for example.

Figure 8:
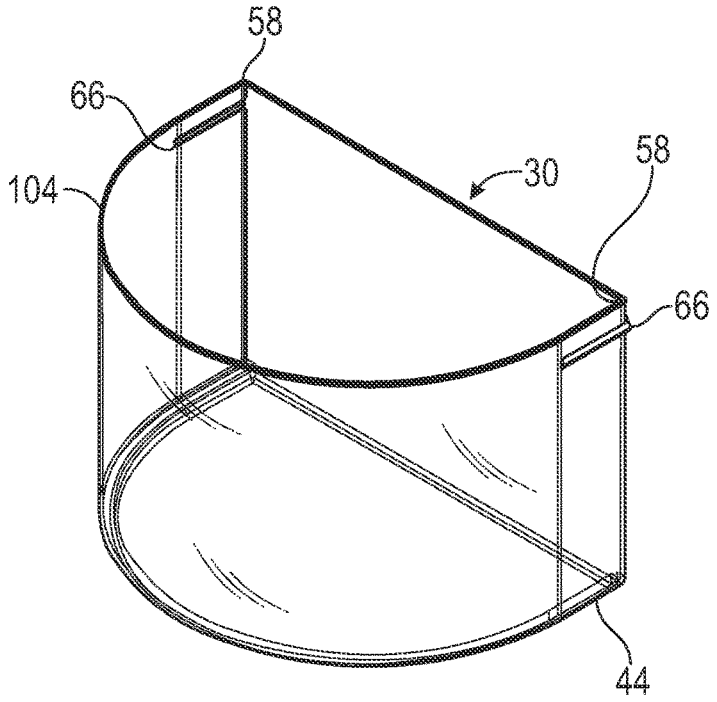
FIG. 8 is a perspective view of an exemplary waste water container.
Figure 9:
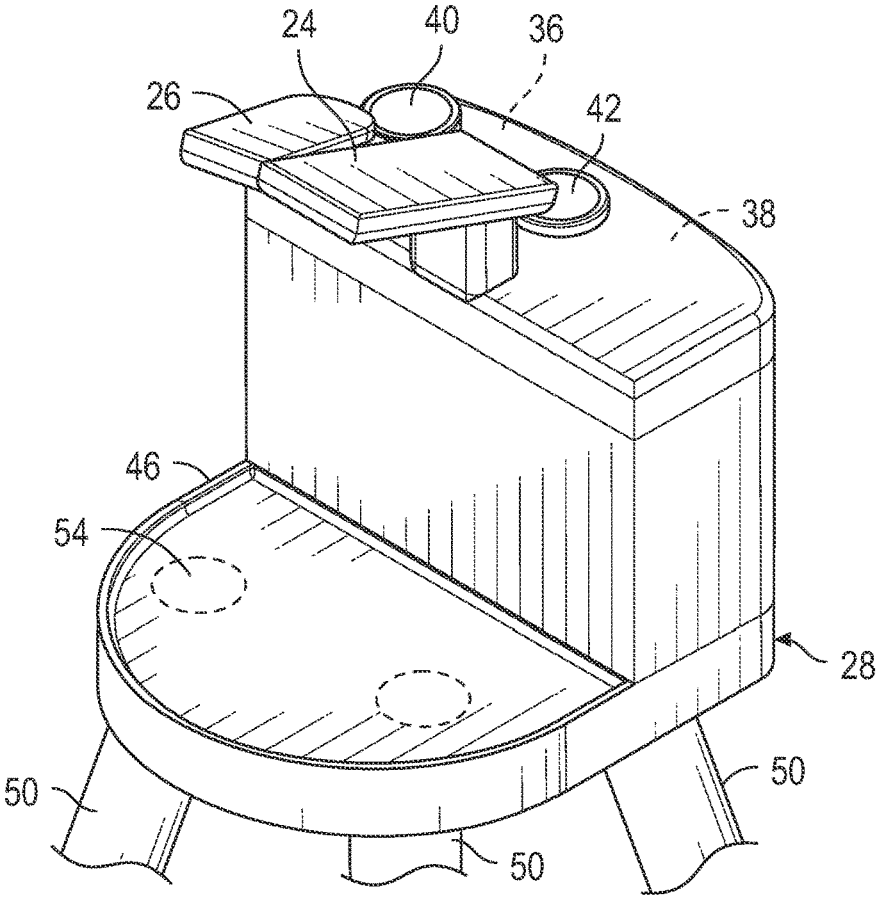
FIG. 9 is a perspective view of an exemplary base.

In an exemplary embodiment, the entire container 30 is transparent to easily allow a user to visually monitor its contents. Moreover, such visual transparency allows a user to easily determine a suitable filling volume when container 30 is used to provide water to fresh water tank 38. As shown in FIG. 8, corners 58 of container 30 may serve as convenient pouring spouts. In an exemplary embodiment, container 30 can hold nearly 2 liters of water (below the level of the floor of the removable upper tray 32), though it is recommended to empty and clean the container 30 when fresh water tank 38 needs refilling. As shown in FIGS. 2, 8, and 9, in an exemplary embodiment, the bottom perimeter edge of waste water container 30 includes stepped edge 44 to allow easy yet snug placement of the container 30 onto perimeter ridge 46 of container platform 54 of sink base 28. The depth of the step is approximately ¾" of an inch, providing additional stability and adherence of the waste water container 30 to the container platform 54 of the sink base 28. Thus, separation of the waste water container 30 from the sink base 28 occurs only when a user intentionally lifts the waste water container 30 upwards.

In an exemplary embodiment, upper tray 32 functions as a barrier between the contents of the waste water container 30 and the child, while allowing the running water from faucet 24 to exit the tray 32 through small holes 48 and drain into the waste water container 30. Upper tray 32 also functions to contain debris, thereby preventing larger objects, such as water toys or towels, from falling into the lower portion of waste water container 30. Because most of the used water drains from upper tray 32 and into a child-inaccessible area 106 of waste water container 30, the configuration of sink 20 minimizes the chance of water splashing onto the floor surface 34 when a child washes his or her hands. In an exemplary embodiment, a rate of water that flows through faucet 24 is less than a rate of water drainage from tray 32 through drain holes 48 to prevent pooling of standing water in upper tray 32.

In an exemplary embodiment, upper tray 32 is shaped like an open-ended half-cylinder, oriented with the open end accessible from above. It approximates the width and horizontal depth contours of the waste water container 30 minus a fractional amount, to allow the tray 32 to be inserted and fit into a top portion of the waste water container 30. In an exemplary embodiment, floor 110 of upper tray 32 dips or slopes downward toward drain holes 48. In an exemplary embodiment, the height of upper tray 32 is approximately half or less compared to the height of the waste water container 30. In an exemplary embodiment, the bottom of the tray 32 has symmetrically-spaced holes 48 arranged in a circular pattern near a center thereof. In an exemplary embodiment, the drain arrangement includes symmetrically spaced holes 48, each sized with a 0.25" diameter.

In an exemplary embodiment, tray 32 is affirmatively attached to waste water container 30 by clips 62. In an exemplary embodiment, clips 62 are positioned along the top perimeter of the tray 32 near the two corners 60. As shown in FIGS. 1, 2, 6 and 7, clips 62 protrude slightly outwards from the upper rim 108 of the upper tray 32. In an exemplary embodiment, clips 62 protrude outward and curve down over the upper sidewall edge 104 of the waste water container 30. Clip 62 includes a nub 64 configured to snap over a ridge 66 provided on an outside surface of waste water container 30. As shown in FIG. 2, the fit of the clip 62 relative to ridge 66 is tight, which allows the tray 32 to effectively snap and hold securely onto the waste water container 30. In an exemplary embodiment, each clip 62 is approximately 1" to 2.5" in length (measured horizontally along the rim of upper tray 32). The illustrated embodiments show two clips 62, though more or fewer may be used. Additionally, while a particular location and configuration of clips 62 is shown, it is understood that other placements and configurations can also be used.

As shown in FIGS. 2 and 6-8, in an exemplary embodiment, ridge 66 is positioned approximately 0.75" below upper sidewall edge 104 of container 30 and is configured as a horizontal protruding structure, approximately 1/16th to 1/8th of an inch thick in both protruding width and height, and approximately 1" to 2.5" in horizontal length. On both sides of sink 20, ridge 66 is centered and aligned with clip 62 for cooperating engagement. This ridge 66 provides resistance to any unwanted relative vertical movement between upper 32 tray and container 30. In an exemplary embodiment, ridge 66 has a trapezoidal cross-sectional shape with inclined face 56; outer face 68 meets horizontally extending bottom wall 72.

Figure 7:
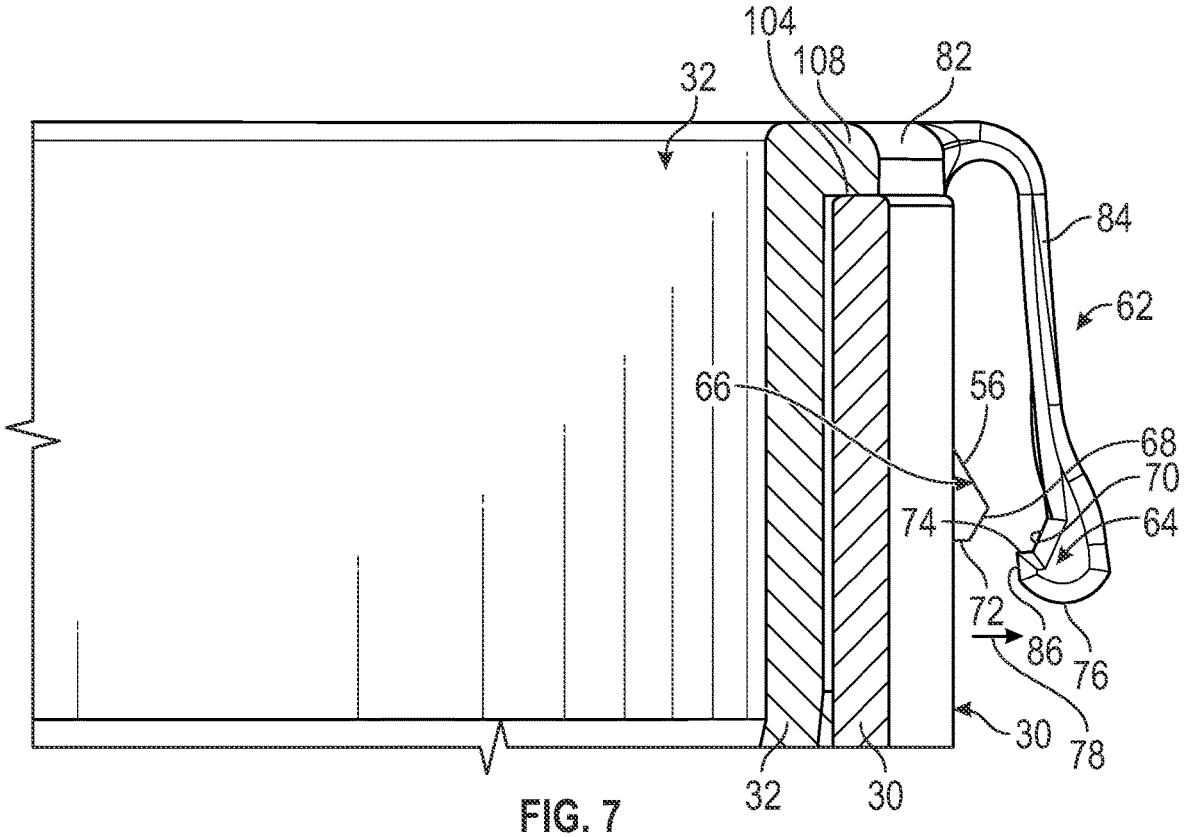
FIG. 7 is similar to FIG. 6, but taken at line 7-7 of FIG. 1, and shows the upper tray clip in a disengaged configuration relative to the waste water container.

In an exemplary embodiment, clip 62 includes a top wall 82, vertical wall 84, and nub 64 with end 86. In an exemplary embodiment, clip 62 has an inclined inner face 70 and a substantially horizontal top nub wall 74 that meets vertical nub end 86. Additionally, nub 64 has a rounded bottom nub wall 76 that connects an outer surface of vertical clip wall 84 and nub end 86. In an exemplary embodiment, the inclination of face 70 of clip 62 substantially matches the inclination of outer face 68 of ridge 66 to form a tight connection when attached as shown in FIG. 2. As shown in FIG. 7, in an exemplary embodiment, the rounded shape of bottom wall 76 of nub 64 assists a user in pulling nub 64 outward in direction 78 to flex clip 62 open, thereby allowing disengagement of clip 62 from ridge 66.

Figure 6:
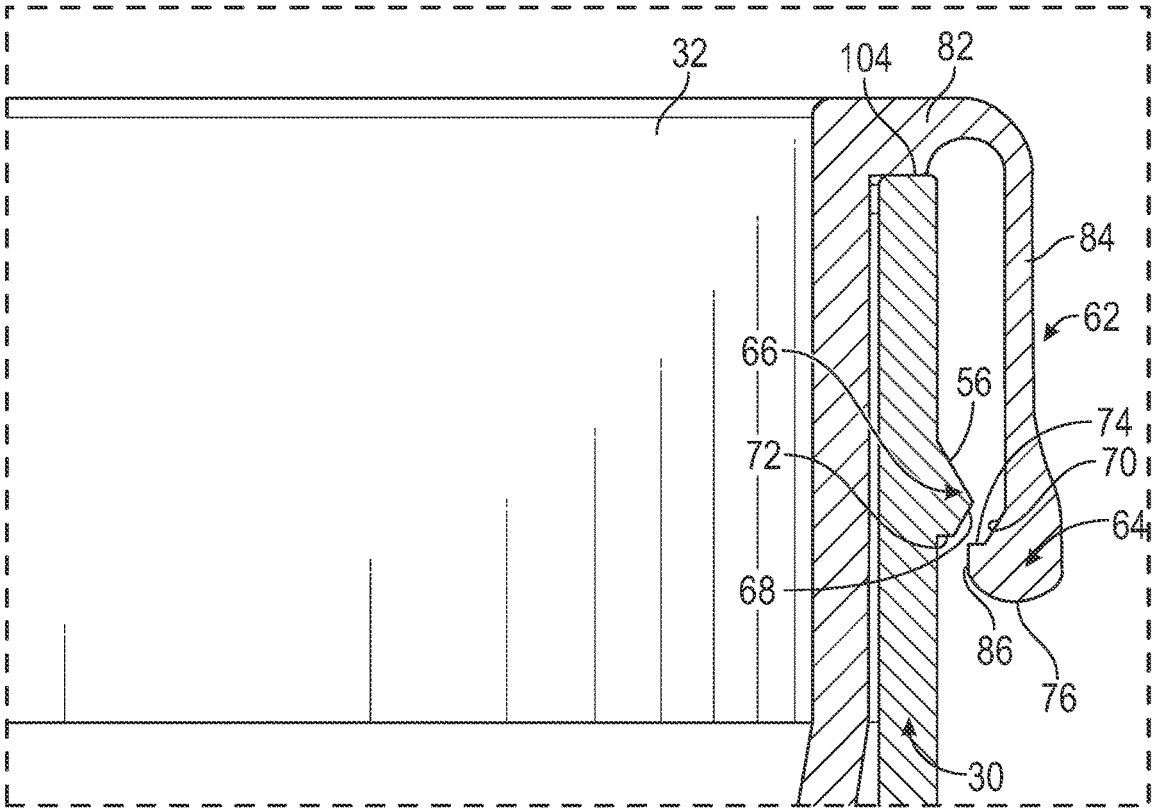
FIG. 6 is a partial cross-sectional view, taken at the dotted region labeled "6" of FIG. 2, of a clip being manipulated to allow for detachment of the upper tray from the waste water container.

In an exemplary embodiment, clips 62 are molded as an integral component of upper tray 32. In an exemplary embodiment, the materials and construction of clip 62 and ridge 66 are designed so that the required force is great enough that the upper tray 32 would not be separated from the waste water container 30 due to moderate inertial forces (e.g. shaking or agitating). However, the required force is not so great as to preclude the easy separation of the upper tray 32 from the waste water container 30 when doing so intentionally uses the proper technique, as illustrated in FIGS. 5-7.

For example, detaching the upper tray 32 from the waste water container 30 can be accomplished by grasping the clips 62 with fingers so that the fingertips contact the bottom wall 76 of the clips. The user applies a relatively light force to flex clips 62 outward in direction 78. Re-inserting the upper tray 32 onto the waste water container 30 is accomplished by positioning the tray 32 over the waste water container 30 and applying a light-to-moderate vertical downward force on the rim 108 of the upper tray 32. This force will then transfer itself into the clips 62. Due to flexure allowed by the clips 62 and the complementary inclination of face 56 of ridge 66 and the roundness of bottom wall 76 of nub 64, nub 64 will bend outward in direction 78 and slide past ridge 66 in a downward direction. Thus, upper tray 32 will snap onto waste water container 30. At this point, the upper tray 32 is clipped securely to the waste water container 30. Exemplary dimensions for waste water container 30 and sink upper tray 32 are shown in TABLES 1 and 2. These dimensions provide a sink 20 that is light-weight and compact. However, it is contemplated that the disclosure is also applicable to structures of other sizes and shapes.

TABLE 1

Exemplary dimensions for waste water container 30

| Dimension | US Imperial | Metric |
|---|---|---|
| Width | 10" | 25.4 cm |
| Depth | 5" | 12.7 cm |
| Height | 7" | 17.78 cm |
| Height below upper tray 32 | 3" | 7.62 cm |
| Volume of contained water = $0.5\pi \times * 0.5\ w^2 * h$ | 65.3 fl oz | 1.93 L |

TABLE 2

Exemplary dimensions for sink upper tray 32

| Dimension | US Imperial | Metric |
|---|---|---|
| Width | 9.875" | 25.08 cm |
| Depth | 4.875" | 12.38 cm |
| Height | 4" | 10.16 m |

Figure 10:
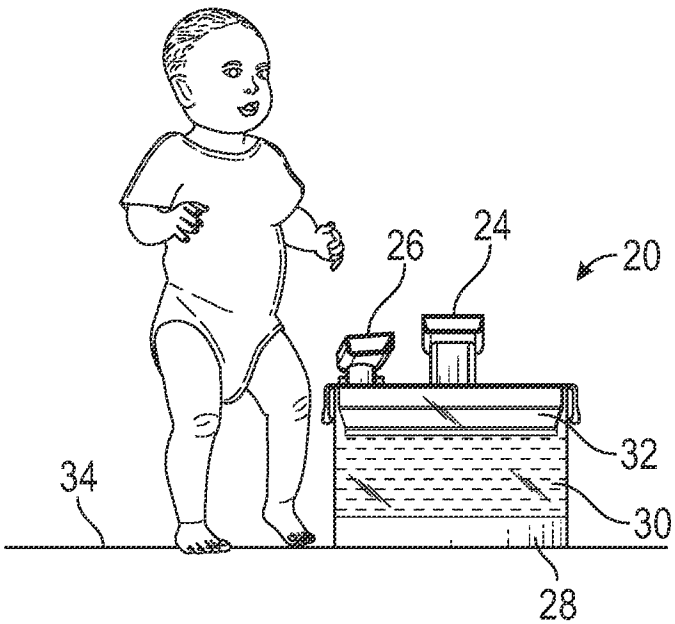
FIG. 10 is a front elevation view of an exemplary sink placed on a floor surface, for use by a small child.

FIG. 10 is an elevation view of an exemplary sink 20 placed on a floor surface 34, for use by a small child. FIG. 11 is an elevation view of an exemplary sink 20 placed on an optional leg assembly 22*b* to raise the sink above a floor surface 34, for use by a taller child. Children grow about 4-5 inches in the second year of life and about 3-4 inches in the third year. While not specifically illustrated, it is contemplated that sink 20 can be placed on any stable surface of suitable height for a particular child and location, such as a bench, for example.

Figure 12:
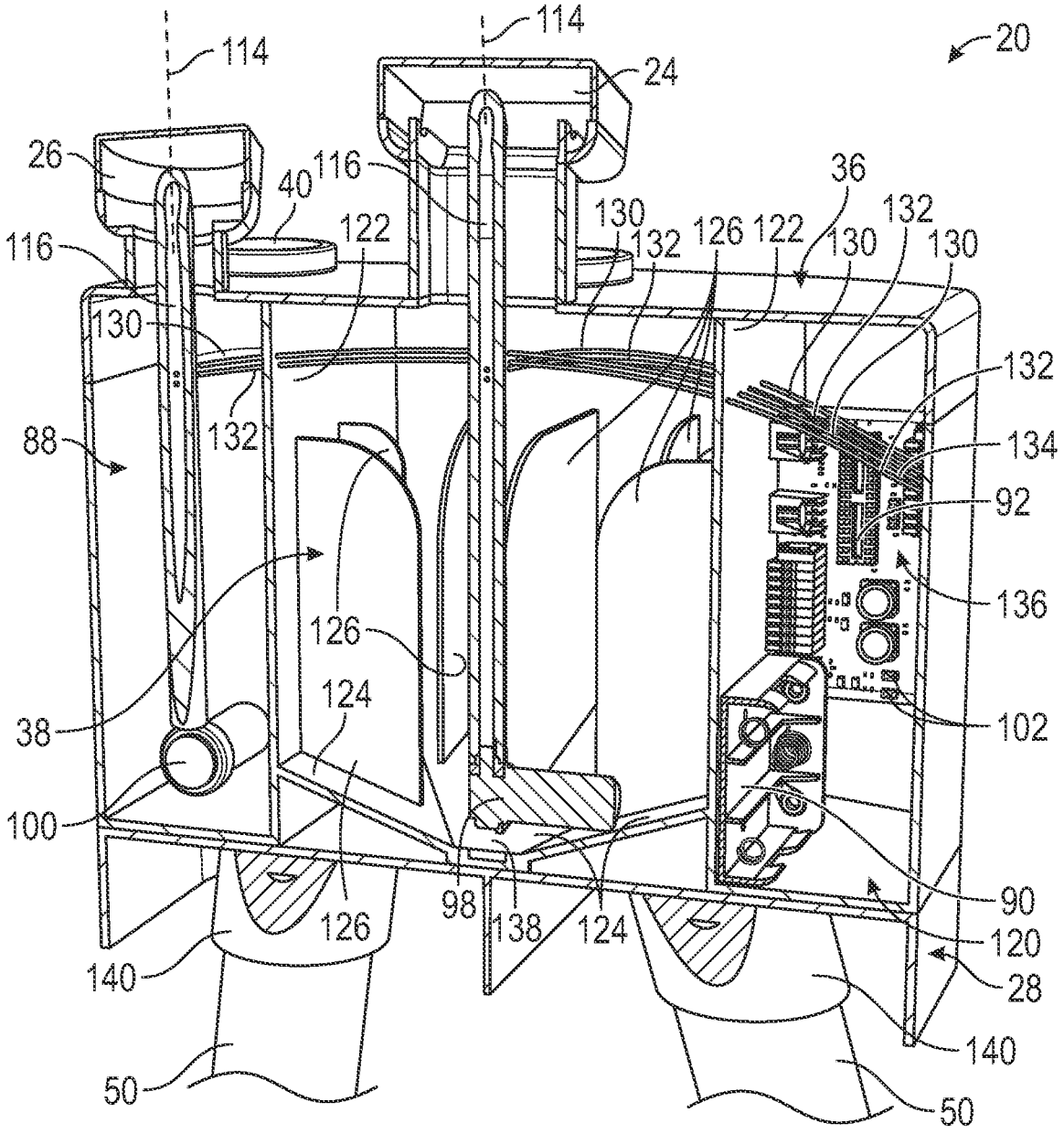
FIG. 12 is a partial cross-sectional view of an exemplary sink, taken at line 12-12 of FIG. 1.
Figure 13:
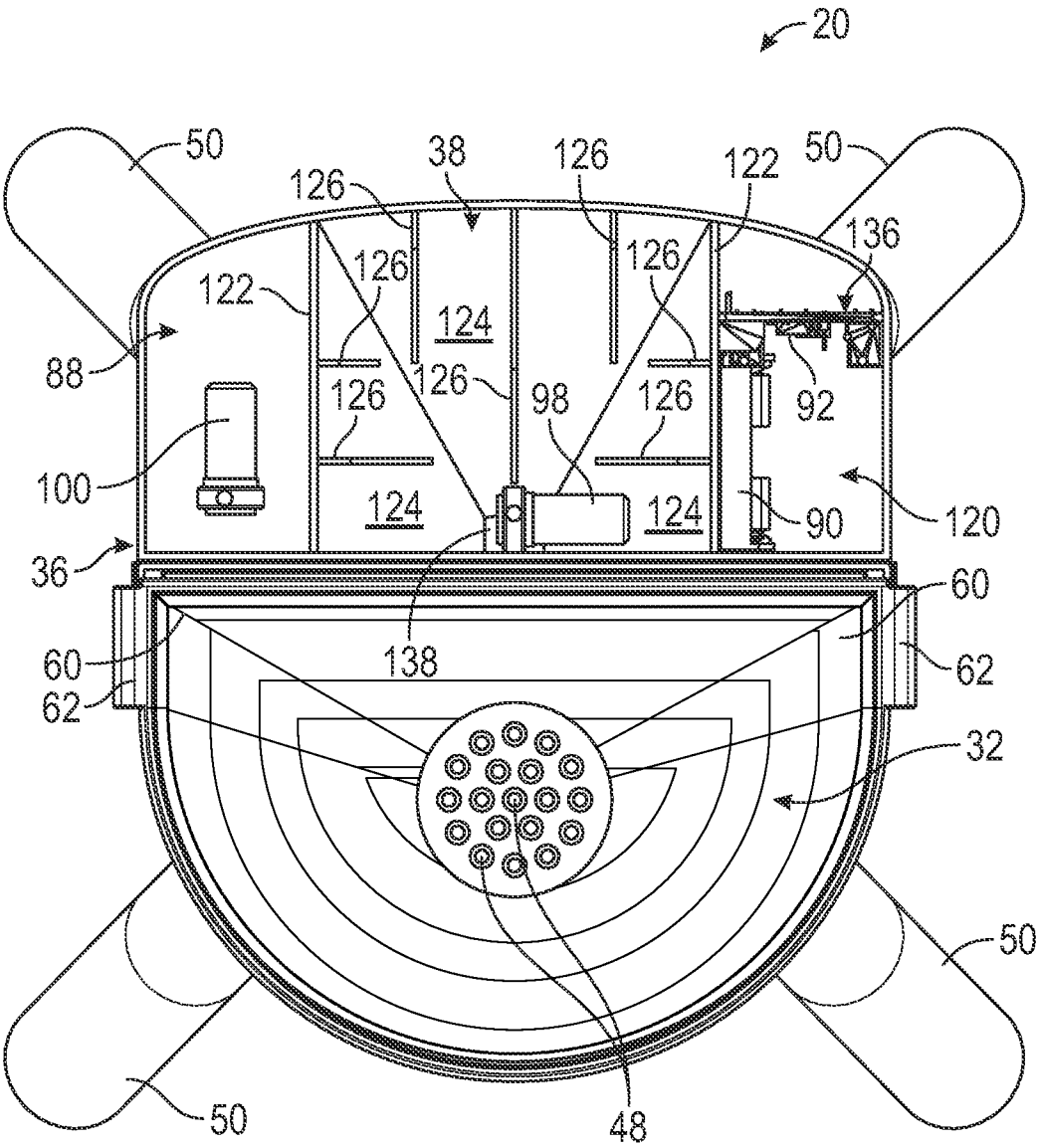
FIG. 13 is a top view of the sink with an interior view of the housing.

As shown in FIGS. 1, 3 and 4, in one embodiment of leg assembly 22*a*, legs 50 splay outward toward ground surface 34, thereby offering a stable support for sink 20 that is sturdy and reliable. As shown in FIGS. 4 and 13, the legs are configured to extend from corners of the sink 20, so that no leg is in the child's way at the front of the sink 20. As shown in FIG. 11, where longer legs 50 are used, leg assembly 22*b* may include two legs 50 attached by a cross brace 52. In an exemplary embodiment, the brace 52 retains the legs 50 in a splayed configuration that is wider at the bottom than at the top, for added stability. As shown in FIG. 12, in an exemplary embodiment, the top of each leg 50 slides into a sleeve 140 in the bottom of base 28.

In one embodiment, multiple sets of stackable leg assemblies 22 are provided. Each set raises the total height of the sink base 28 from the floor 34 by 4". At the base of each leg 50 is a thickened but hollowed-out segment 1.5" in length. The top of any other leg 50 can be inserted into this segment, thus allowing for additional height gains by the use of multiple legs vertically stacked and attached to each other. In other embodiments, height adjustability can be provided by telescoping features. In yet other embodiments, leg assemblies of different heights can be provided as accessory features.

TABLE 3

Exemplary dimensions for leg assembly 22

| Dimension | US Imperial | Metric |
|---|---|---|
| Diameter | 1.5" | 3.81 cm |
| Height | 5.5" | 13.97 cm |
| Insertion Depth | 1.5" | 3.81 cm |
| Rake (angle from front) | 5° | |
| Splay (angle from side) | 5° | |

As shown in FIG. 9, in an exemplary embodiment, sink base 28 includes container platform 54, fresh water tank 38 and housing 36. Waste water container 30 fits onto container platform 54 and in turn holds upper tray 32. Fresh water tank 38 holds water to be dispensed during washing. As shown in FIG. 4, housing 36 contains soap container 88, battery assembly 90, microcontroller 92, sensor 94 for water dispensing, sensor 96 for soap dispensing, water pump 98, soap pump 100, and transistors 102, among other electronic items and internal components, such as plumbing tubes 116 and other mechanisms. In an exemplary embodiment, base 28 also allows for the attachment of leg assemblies 22 via four equally spaced indentations or sleeves 140, into which legs 50 may be attached.

As shown in FIGS. 3 and 5, viewed from the side, base 28 resembles an "L" shape. From this perspective, container platform 54 of the horizontal portion of the "L" shape is designed to fit snugly to and hold the waste water container 30 and its associated upper tray 32. As shown in FIG. 9, in an exemplary embodiment, the perimeter edge 46 of the container platform 54 has a vertically-extruded lip or ridge to help facilitate the easy placement and retention of the waste water container 30. The lip's shape corresponds to the stepped shape of the bottom perimeter edge 44 of waste water container 30 to help ensure a snug fit and a near-unbroken smooth outer surface between the sink base 28 and the waste water container 30.

In an exemplary embodiment, the vertical portion of the base 28 includes housing 36 and contains fresh water tank 38, soap compartment 88 and electronics compartment 120. In an exemplary embodiment, fresh water tank 38, accessible when water plug 42 is removed, has a capacity of approximately 1.15 liters of fresh water. Water tank 38 may optionally have a fill line positioned to mark 1 liter of stored fresh water. In an exemplary embodiment, a liquid soap container 88, accessible when soap plug 40 is removed, has a capacity of approximately 350 milliliters of liquid soap.

Base 28 can include optional features such as a toothbrush pocket or clip-in towel holder, for example.

In an exemplary embodiment, fresh water from fresh water tank 38 is dispensed through motion-activated faucet 24, and soap from the soap compartment 88 is dispensed from motion-activated soap dispenser 26. In an exemplary embodiment, water faucet 24 is an automatic, touch-free component with a motion/object sensor 94 for determining when to dispense water using an electric water pump 98 connected to fresh water tank 38. When triggered by the motion/object sensor 94, the electric water pump 98 pushes water from tank 38 through an interior pathway 116 leading up and forward through the nozzle of faucet 24, to be dispensed above the user's hands.

In an exemplary embodiment, both the water faucet 24 and liquid soap dispenser 26 contain motion/object sensors 94, 96 that utilize light reflectivity-sensing technology in the form of narrow field of view digital distance sensors, detecting the presence of nearby objects in their field of view. Each motion/object sensor unit is built around a digital distance sensor that detects the presence of an object within a distance of a few inches (typically between 0.2" and 4") from the sensor. The field of view of the digital distance sensor is narrow, extending approximately 5 to 10 degrees off of the primary axis of the sensor's line of sight. The faucet and soap dispenser each have one digital distance sensor. A suitable distance sensor is commercially available from Pololu Corporation as the Pololu Digital Distance Sensor 5 cm under model 4050.

The digital distance sensors have electrical connections to a microcontroller 92 for applying specific, discrete voltage levels appropriate to whether motion, or an object blocking their field of view, is detected. A single programmable microcontroller 92 is used to receive signals from the object sensors 94, 96, determine the appropriate action required (enable or disable the water pump 98 and/or soap pump 100), and execute the action within a discrete time interval, based on the logic programmed into the microcontroller 92. This controller 92 is connected to two digital distance sensors 94, 96 and two transistors. A suitable microcontroller 92 is commercially available from MicroChip Technology Inc., under model AVR64DB28.

The microcontroller 92 has electrical connections to the control pins of a set of transistors 102, through which, based on its programmed logic, it applies appropriate voltage levels to the transistors 102. Each of the two transistors 102, in addition to a connection with the microcontroller 92, also contains a connection to the battery assembly 90 and a connection to its respective electric pump 98, 100. Based on an appropriate voltage level received on its control pin, the transistor will either will allow or prevent electrical current to flow from the battery assembly 90 to the electric pump 98, 100, thus switching the pump on and off. Metal-Oxide-Semiconductor Field Effect Transistors 102 (MOSFETs) are used to switch on and off the electrical pumps 98, 100, based on a signal received from a microcontroller 92. Each electric pump 98, 100 is connected to one transistor 102. A suitable MOSFET is commercially available from Infineon Technologies under model IRLB8721PBF.

A removable cover (not shown) in housing 36 provides user access to install or replace the batteries that provide electrical power. In an exemplary battery assembly 90, six (6) AA batteries are used, each of a nominal 1.5 VDC (volts of direct current). The batteries are arranged in two parallel-connected sets of three-battery series, supplying a nominal 4.5 VDC to all electrical components of the sink 20. The battery assembly 90 is connected to all of the other electronic and electromechanical components. A suitable battery assembly 90 is commercially available from Pololu Corporation, under model number 142. In an exemplary embodiment, a quantity of two such battery assemblies is used to contain six AA batteries, with three batteries allocated to each assembly. This allows each assembly to provide a nominal 4.5 VDC from the three batteries wired as a series, and with both assemblies wired in parallel, double the total amperage and thus wattage is made available for a longer-running operating lifetime before the batteries are drained.

The electronics utilized in the operation of the motion/object sensors and water pumps are designed to operate on a supply voltage range of 3.3 VDC to 5 VDC, allowing for the use of rechargeable NiCD and NiMH AA batteries delivering a nominal 1.2 VDC each, and single-use Alkaline or Carbon Zinc batteries delivering a nominal voltage of 1.5 VDC each. In an exemplary embodiment, the minimum required voltage is 3.3 VDC, and the never-exceed voltage is 6 VDC.

TABLE 4

Typical expected current utilization for various scenarios:

| Scenario | Maximum Current Draw (at 4.5 VDC) |
|---|---|
| Quiescent state, no motion detected | 20 mA |
| Water pump running | 200 mA |
| Soap pump running | 250 mA |
| All electrical devices running ("worst-case" scenario) | 450 mA |

The removable battery cover features a gasket seal to prevent water entry into the battery compartment. A "master" On/Off switch is located inside the battery compartment, providing a single-source control point over the electrical connection between the power source (battery assembly 90) and power-consuming devices (controller 92, motion/object sensors 94, 96, water pump 98, soap pump 100, and transistors 102, for example).

Electric pumps 98, 100 are used to deliver water and soap from their respective containers 38, 88 through their respective dispensers 24, 26. The faucet 24 and soap dispenser 26 each have one electric pump 98, 100. A suitable electric pump is commercially available from Shenzhen Beanfeng Electronic Technology Co., Ltd. under model JT-DC3L-4.5. Detection of an object sends a voltage signal from the distance sensor 94, 96, triggering the electric pump 98, 100 that is in the same circuit as the distance sensor 94, 96.

In the case of the pump 98 attached to the water faucet 24, the water pump 98 will continue pumping water through the faucet spout 24 for as long as an object is detected by sensor 94, plus an additional time duration of approximately two seconds beyond the moment when an object was last detected, up to a maximum of fifteen seconds. After the faucet 24 ceases dispensing water, a "cool-down" period is in effect, during which the faucet 24 will not dispense water for up to ten seconds. This allows for an uninterrupted stream flowing of water in situations where a user's hands may temporarily leave the sensor's 94 field of view but not necessarily out of the stream of flowing water, only to return a fraction of a second later.

In an exemplary embodiment, the liquid soap dispenser 26 is an automatic, touch-free component with a motion/object sensor 96 for determining when to dispense soap and an electric pump 100 to facilitate the dispensation of the liquid soap. When triggered by the motion/object sensor 96, the electric pump 100 pushes liquid soap through an interior pathway 116 leading up and forward through the soap dispenser's nozzle 26, to be dispensed above the user's hands.

In contrast to the mode of water dispensation, in an exemplary embodiment, for the pump 100 attached to the liquid soap dispenser 26, the soap pump 100 will run for a fraction of a second, when an object is detected by the distance sensor 96, to trigger the release of a small quantity of liquid soap, approximately ⅛th of a fluid ounce. A "cool-down" period of three seconds will then take place, with no liquid soap dispensed during that time.

TABLE 5

Exemplary dimensions for sink base 28 and housing 36

| Dimension | US Imperial | Metric |
|---|---|---|
| Width | 10" | 25.4 cm |
| Height from bottom to lower floor surface | 2" | 5.08 cm |
| Total Height | 9.5" | 24.13 cm |
| Depth (vertical wall to front) | 5" | 12.7 cm |
| Depth to faucet (back to front of faucet) | 7.5" | 19.05 cm |
| Total Depth (back to front) | 10" | 25.4 cm |
| Fresh Water Tank Volume | 38.9 fl oz | 1.15 L |
| Liquid Soap Container Volume | 11.8 fl oz | 350 |

Exemplary, non-limiting embodiments of a sink apparatus are described. For example, an apparatus 20 includes a base 28; a reservoir 38, 88 connected to the base 28 and configured to hold a fluid; a first vessel 30 having a first volume and configured to be removably connected to the base 28; a connection 24, 26, configured to deliver the fluid from the reservoir 38, 88 to at least the first vessel 30; and a second vessel 32. The second vessel 32 is configured to be disposed at least partially within the first vessel 30; configured to be removably secured to the first vessel 30; and includes an aperture 48 that allows for fluid communication between the second vessel 32 and the first vessel 30. The second vessel 32 has a second volume that is less than the first volume.

In an exemplary embodiment, the apparatus 20 includes a clip 62 that is configured to secure the second vessel 32 to the first vessel 30. In an exemplary embodiment, the clip 62 is disposed proximate a rim 108 of the second vessel 32. In an exemplary embodiment, the clip 62 extends outward and downward over a rim 104 of the first vessel 30. In an exemplary embodiment, the first vessel 30 includes a ridge 66 configured to engage with the clip 62. In an exemplary embodiment, the clip 62 includes a nub 64 configured to contact the ridge 66. In an exemplary embodiment, the ridge 66 has a substantially trapezoidal cross-sectional shape. In an exemplary embodiment, the ridge 66 includes a first inclined face 56. In an exemplary embodiment, the ridge 66 includes an outer face 68 connected to the first inclined face 56. In an exemplary embodiment, the ridge 66 comprises a horizontal bottom wall 72 connected to the outer face 68. In an exemplary embodiment, the clip 62 includes a nub 64 configured to contact the ridge 66, the nub 64 having a second inclined face 70 that substantially matches an inclination angle of the outer face 68. In an exemplary embodiment, the nub 64 comprises a horizontal top wall 74 connected to the second inclined face 70.

In an exemplary embodiment, the connection 24, 26 operably communicates with a fluid pump 98, 100. In an exemplary embodiment, an object sensor 94, 96 is operably connected to the fluid pump 98, 100. In an exemplary embodiment, a controller 92 is operably connected to the object sensor 94, 96. In an exemplary embodiment, a battery 90 is operably connected to the controller 92.

In an exemplary embodiment, a leg 50 is configured for connection to the base 28. In an exemplary embodiment, a third volume of the reservoir 38, 88 is less than the first volume. In an exemplary embodiment, the first vessel 30 has a semi-circular shape. In an exemplary embodiment, the first vessel 30 is visually transparent.

FIG. 12 is a partial cross-sectional view of housing 36 of an exemplary sink 20, taken at line 12-12 of FIG. 1. In an exemplary embodiment, water tank 38 is separated from the soap container 88 and from the electronic compartment 120 by tank walls 122. In an exemplary embodiment, water pump 98 is placed at a bottom of the water tank 38 and proximate a valley 138 to direct water up pipe 116, through faucet 24 and out nozzle 118 (see FIGS. 14 and 15). An exemplary water tank 38 includes inclined floors 124 to funnel water into the vicinity of water pump 98. Moreover, baffles 126 are provided within water tank 38 to attenuate liquid motion and sloshing as sink 20 is moved from one location to another. In the illustrated embodiments, each baffle 126 is configured as a wall of partial height (having a height less than that of fresh water tank 38) and of partial width (having a horizontal extent that does not traverse an entire length or width dimension of the fresh water tank 38). However, in other embodiments, a baffle 126 need not be strictly vertical and could extend an entire height or width of the fresh water tank 38. Moreover, while each baffle 126 is illustrated with a curved or arcuate top edge, other shapes and configurations of baffles are also suitable.

In an exemplary embodiment, soap pump 100 is disposed in soap container 88 proximate a bottom surface thereof to pump liquid cleanser up pipe 116 and out nozzle 118 of soap dispenser 26. While not specifically illustrated, the electronics compartment 120 may have an access door in an exterior wall of housing 36 to allow for changing of the batteries in the battery assembly 90, for example.

In an exemplary embodiment, each of pipes 116 is fitted with a resistance measurement wire 130 and a ground wire 132 near an upper portion of the pipe 116 in the housing 36. The wires 130, 132 pass through or around the fresh water tank 38 to connect to pins 134 on circuit board 136. These components facilitate operation of soap and water priming mechanisms to ensure immediate availability of either liquid soap or fresh water in the respective pipe 116 for dispensing through nozzles 118 on demand. Each set of the wires 130, 132 penetrates the pipe or tube 116 and are separated from each other by a gap; preferably, a range of 1 millimeter to 20 millimeters of spacing is disposed between each resistance measurement wire 130 and its respective ground wire 132.

In an exemplary embodiment, each resistance measurement wire 130 connects to an analog to digital converter of microcontroller 92 and to a known resistor (such as one exhibiting 10 KiloOhms), which in turn connects to the electrical voltage supply from the battery assembly 90. The ground wire 132 connects to an electrical ground of the circuit board 136.

In an exemplary embodiment, a priming operation for the water faucet 24 and for the soap dispenser 26 are similar. Once the sink 20 is set up in a desired location and filled with water in the fresh water tank 38 and liquid soap in the soap compartment 88, the user places his/her hands under the sensors 94, 96 (see FIG. 14) to initiate the priming operation. The microcontroller 92, through signals provided by the resistance measurement wire 130, quantifies the resistance in the electrical circuit to determine the presence of soap or water in the respective pipe 116. High resistance, such as 1

MegaOhm, indicates a lack of liquid. Low resistance, such as 100 KiloOhms for soap or 20 KiloOhms for water, indicates the presence of liquid. If the liquid is detected, the respective soap or water pump is not engaged, as the presence of liquid indicates that the pipe 116 is primed for the immediate dispensing of liquid or soap. However, if liquid is not detected in the pipe 116 at the connections of wires 130, 132, the relevant pump 98, 100 is engaged until the presence of the liquid is confirmed in the pipe 116 at the level of the wires 130, 132, thus priming the respective faucet 24, 26.

In an exemplary embodiment, the microcontroller 92 is programmed with on/off triggers (i.e., thresholds) for priming the water pipe 116 at about 1 MegaOhm for turning water pump 98 on and about 40 KiloOhms for turning water pump 98 off. Thus, if the resistance detected by resistance measurement wire 130 of the water pipe 116 in water tank 38 is less than 1 MegaOhm, the water pump 98 does not turn on for priming, as the water pipe 116 already contains water. However, if the resistance detected by resistance measurement wire 130 of the water pipe 116 in water tank 38 is over 1 MegaOhm, the water pump 98 runs to fill the pipe 116. Several resistance measurements are taken per second; the water pump 98 runs until the resistance detected by resistance measurement wire 130 of the water pipe 116 in water tank 38 is less than 40 KiloOhms, at which point the water pump 98 stops, as the priming operation for water pipe 116 is complete.

In an exemplary embodiment, the microcontroller 92 is programmed with on/off triggers (i.e., thresholds) for priming the soap pipe 116 at about 1 MegaOhm for turning soap pump 100 on and about 200 KiloOhms for turning soap pump 100 off. Thus, if the resistance detected by resistance measurement wire 130 of the soap pipe 116 in soap compartment 88 is less than 1 MegaOhm, the soap pump 100 does not turn on for priming, as the soap pipe 116 already contains soap. However, if the resistance detected by resistance measurement wire 130 of the soap pipe 116 in soap compartment 88 is over 1 MegaOhm, the soap pump 100 runs to fill the pipe 116. Several resistance measurements are taken per second; the soap pump 100 runs until the resistance detected by resistance measurement wire 130 of the soap pipe 116 in soap compartment 88 is less than 200 KiloOhms, at which point the soap pump 100 stops, as the priming operation for soap pipe 116 is complete.

After the resistance measurements and priming are complete for the pipes 116 for water faucet 24 and soap dispenser 26, when the respective sensor 94, 96 for water or soap detects an object such as the user's hands in the vicinity of the faucet 24 or dispenser 26, the relevant pump 98, 100 operates to induce liquid flow from the water tank 38 or soap container 88, up through the pipe 116 and out the nozzle 118. When no object is detected by the water sensor 94 or the soap sensor 96, the relevant pump 98, 100 disengages to prevent liquid spillage into the upper tray 32.

FIG. 13 is a top view of an exemplary sink 20, showing an interior of housing 36. Pipes or tubes 116, as well as their connected resistance measurement wires 130 and ground wires 132 are omitted from this view. As seen in FIGS. 12 and 13, in an exemplary embodiment, three segments of sloped floor 124 incline downward from their respective walls 122 to direct water to valley 138, from which water pump 98 retrieves the liquid for sending up the pipe 116 to the water faucet 24.

Exemplary, non-limiting embodiments of an apparatus and method are described. In an exemplary embodiment, an apparatus 20 comprises a base 28, a first reservoir 38, 88, a first vessel 30, a first conduit 116, a first sensor 94, 96, a first resistance measurement wire 130 connected to the first conduit 116, a microprocessor 92, and a first pump 98, 100. In an exemplary embodiment, the first reservoir 38, 88, is disposed on the base 28 and is configured to hold a first fluid such as water or soap 38, 88. In an exemplary embodiment, the first vessel 30 has a first volume equal to or greater than a volume of the reservoir 38, 88, and the first vessel 30 is configured to be connected to the base 28. In an exemplary embodiment, the first conduit 116 is configured to deliver the first fluid (such as water or soap) from the first reservoir 38, 88 to at least the first vessel 30. In an exemplary embodiment, the microprocessor 92 is configured to receive a first signal from the first sensor 94, 96 indicative of whether an object (such as a user's hand) is disposed proximate the first sensor 94, 96; and receive a second signal from the first resistance measurement wire 130 indicative of a resistance measurement of the first conduit 116. The first pump 98, 100 is configured to provide a motive force to the first fluid through the first conduit 116 in a circumstance in which the first signal indicates that the object is disposed proximate the first sensor 94, 96 and the second signal indicates that the resistance measurement of the first conduit 116 is above a first threshold, wherein the first threshold corresponds to a lack of the first fluid in the first conduit.

In an exemplary embodiment, a first ground wire 132 is connected to the first conduit 116. In an exemplary embodiment, a first dispenser 24, 26 is provided, through which the first conduit 116 delivers the first fluid from the reservoir 38, 88 to at least the first vessel 30. In an exemplary embodiment, the first sensor 94, 96 is disposed on the first dispenser 24, 26. In an exemplary embodiment, the first dispenser 24, 26 is pivotally connected to the base 28.

In an exemplary embodiment, the first reservoir 38 comprises a plurality of baffles 126. In an exemplary embodiment, the first reservoir 38 comprises a sloped floor 124 having a valley 138. In an exemplary embodiment, the first pump 98 is disposed proximate the valley 138.

In an exemplary embodiment, the apparatus 20 comprises a second reservoir 38, 88, a second conduit 116, a second sensor 94, 96, a second resistance measurement wire 130 connected to the second conduit 116, and a second pump 98, 100. In an exemplary embodiment, the second reservoir 38, 88, is disposed on the base 28 and is configured to hold a first fluid such as water or soap 38, 88. In an exemplary embodiment, the second conduit 116 is configured to deliver the second fluid (such as water or soap) from the second reservoir 38, 88 to at least the first vessel 30. In an exemplary embodiment, the microprocessor 92 is configured to receive a third signal from the second sensor 94, 96 indicative of whether an object (such as a user's hand) is disposed proximate the second sensor 94, 96; and receive a fourth signal from the second resistance measurement wire 130 indicative of a resistance measurement of the second conduit 116. The second pump 98, 100 is configured to provide a motive force to the second fluid through the second conduit 116 in a circumstance in which the third signal indicates that the object is disposed proximate the second sensor 94, 96 and the fourth signal indicates that the resistance measurement of the second conduit 116 is above a second threshold, wherein the second threshold corresponds to a lack of the second fluid in the second conduit.

In an exemplary embodiment, the apparatus 20 comprises a second vessel 32 that is configured to be disposed at least partially within the first vessel 30. In an exemplary embodiment, the second vessel 32 comprises an aperture 48 that allows for fluid communication between the second vessel 32 and the first vessel 30. In an exemplary embodiment, the second vessel 32 has a second volume that is less than the first volume.

In an exemplary embodiment, the apparatus 20 comprises a battery, such as in battery assembly 90, operably connected to the microprocessor 92. In an exemplary embodiment, the first vessel 30 is visually transparent.

An exemplary method comprises receiving a first signal from the first sensor 94, 96 indicative of whether an object (such as a hand) is disposed proximate the first sensor 94, 96; receiving a second signal from the first resistance measurement wire 130 indicative of a resistance measurement of the first conduit 116, wherein a first threshold corresponds to a lack of the first fluid in the first conduit 116; determining that the first signal correlates with presence of the object proximate the first sensor 94, 96; determining that the second signal correlates with the lack of the first fluid (such as water or soap) in the first conduit 116; and providing a first motive force to the first fluid through the first conduit 116, with the first pump 98, 100.

An exemplary method further comprises determining that the first signal correlates with absence of the object proximate the first sensor; and continuing to provide the first motive force until the second signal is indicative that the resistance measurement of the first conduit 116 is below the first threshold. Thus, in this case, once the soap or water priming begins, it continues until the respective pipe 116 contains an amount of liquid to meet the resistance measurement threshold indicating an adequate amount of water or soap to prime the dispenser 24, 26, even if the user's hands are taken away before priming is complete.

An exemplary method of using apparatus 20 includes pivoting the first dispenser 24, 26 relative to the base 28. In an exemplary embodiment, the method comprises receiving a third signal from the second sensor 94, 96 indicative of whether the object is disposed proximate the second sensor 94, 96; receiving a fourth signal from the second resistance measurement wire 130 indicative of a resistance measurement of the second conduit 116, wherein a second threshold corresponds to a lack of the second fluid in the second conduit 116; determining that the third signal correlates with presence of the object proximate the second sensor 94, 96; determining that the fourth signal correlates with the lack of the second fluid in the second conduit 116; and providing a second motive force to the second fluid through the second conduit 116, with the second pump 98, 100. In an exemplary embodiment, the method further comprises determining that the third signal correlates with absence of the object proximate the second sensor 94, 96; and continuing to provide the second motive force until the fourth signal is indicative that the resistance measurement of the second conduit 116 is below the second threshold.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An apparatus comprising:
- a base;
- a first reservoir disposed on the base and configured to hold a first fluid;
- a first vessel having a first volume equal to or greater than a volume of the first reservoir, wherein the first vessel is configured to be connected to the base;
- a first conduit configured to deliver the first fluid from the first reservoir to at least the first vessel;
- a first sensor;
- a first resistance measurement wire connected to the first conduit;
- a microprocessor configured to:
  - receive a first signal from the first sensor indicative of whether an object is disposed proximate the first sensor; and
  - receive a second signal from the first resistance measurement wire indicative of a resistance measurement of the first conduit; and
- a first pump configured to provide a first motive force to the first fluid through the first conduit in a first circumstance in which the first signal indicates that the object is disposed proximate the first sensor and the second signal indicates that the resistance measurement of the first conduit is above a first threshold, wherein the first threshold corresponds to a lack of the first fluid in the first conduit.

2. The apparatus of claim 1 comprising a first ground wire connected to the first conduit.

3. The apparatus of claim 1 comprising a first dispenser through which the first conduit delivers the first fluid from the first reservoir to at least the first vessel.

4. The apparatus of claim 3, wherein the first sensor is disposed on the first dispenser.

5. The apparatus of claim 3, wherein the first dispenser is pivotally connected to the base.

6. The apparatus of claim 1, wherein the first reservoir comprises a plurality of baffles.

7. The apparatus of claim 1, wherein the first reservoir comprises a sloped floor having a valley.

8. The apparatus of claim 7, wherein the first pump is disposed proximate the valley.

9. The apparatus of claim 1 comprising:
- a second reservoir disposed on the base and configured to hold a second fluid;
- a second conduit configured to deliver the second fluid from the second reservoir to at least the first vessel;
- a second sensor;
- a second resistance measurement wire connected to the second conduit;
- wherein the microprocessor is configured to:
  - receive a third signal from the second sensor indicative of whether the object is disposed proximate the second sensor; and
  - receive a fourth signal from the second resistance measurement wire indicative of a resistance measurement of the second conduit; and
- a second pump configured to provide a second motive force to the second fluid through the second conduit in a second circumstance in which the third signal indicates that the object is disposed proximate the second sensor and the fourth signal indicates that the resistance measurement of the second conduit is above a second threshold, wherein the second threshold corresponds to a lack of the second fluid in the second conduit.

10. The apparatus of claim 1, comprising a second vessel:
- configured to be disposed at least partially within the first vessel;
- including an aperture that allows for fluid communication between the second vessel and the first vessel; and
- having a second volume that is less than the first volume.

11. The apparatus of claim 1 comprising a battery operably connected to the microprocessor.

12. The apparatus of claim 1, wherein the first vessel is visually transparent.

13. A method of using an apparatus, the apparatus comprising:

a base;

a first reservoir disposed on the base and configured to hold a first fluid;

a first vessel having a first volume equal to or greater than a volume of the first reservoir, wherein the first vessel is configured to be connected to the base;

a first conduit configured to deliver the first fluid from the first reservoir to at least the first vessel;

a first sensor;

a first resistance measurement wire connected to the first conduit;

a microprocessor; and a first pump;

the method comprising:

receiving a first signal from the first sensor indicative of whether an object is disposed proximate the first sensor;

receiving a second signal from the first resistance measurement wire indicative of a resistance measurement of the first conduit, wherein a first threshold corresponds to a lack of the first fluid in the first conduit;

determining that the first signal correlates with presence of the object proximate the first sensor;

determining that the second signal correlates with the lack of the first fluid in the first conduit; and providing a first motive force to the first fluid through the first conduit, with the first pump.

14. The method of claim 13, further comprising:

determining that the first signal correlates with absence of the object proximate the first sensor; and continuing to provide the first motive force until the second signal is indicative that the resistance measurement of the first conduit is below the first threshold.

15. The method of claim 13, wherein the first fluid flows from the first reservoir to at least the first vessel through a first dispenser, the method comprising pivoting the first dispenser relative to the base.

16. The method of claim 13, wherein the apparatus comprises:

a second reservoir disposed on the base and configured to hold a second fluid;

a second conduit configured to deliver the second fluid from the second reservoir to at least the first vessel;

a second sensor;

a second resistance measurement wire connected to the second conduit; and a second pump;

the method comprising:

receiving a third signal from the second sensor indicative of whether the object is disposed proximate the second sensor;

receiving a fourth signal from the second resistance measurement wire indicative of a resistance measurement of the second conduit, wherein a second threshold corresponds to a lack of the second fluid in the second conduit;

determining that the third signal correlates with presence of the object proximate the second sensor;

determining that the fourth signal correlates with the lack of the second fluid in the second conduit; and providing a second motive force to the second fluid through the second conduit, with the second pump.

17. The method of claim 16, further comprising:

determining that the third signal correlates with absence of the object proximate the second sensor; and continuing to provide the second motive force until the fourth signal is indicative that the resistance measurement of the second conduit is below the second threshold.

18. The method of claim 16, wherein the second fluid flows from the second reservoir to at least the first vessel through a second dispenser, the method comprising pivoting the second dispenser relative to the base.

* * * * *